US007680292B2

(12) United States Patent
Warren et al.

(10) Patent No.: US 7,680,292 B2
(45) Date of Patent: Mar. 16, 2010

(54) PERSONAL LISTENING DEVICE

(75) Inventors: Daniel Max Warren, Geneva, IL (US); Thomas Edward Miller, Arlington Heights, IL (US); Charles Bender King, Chicago, IL (US); Janice L. LoPresti, Itasca, IL (US); Gwendolyn P. Massingill, Aurora, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 11/755,408

(22) Filed: May 30, 2007

(65) Prior Publication Data

US 2008/0031481 A1 Feb. 7, 2008

Related U.S. Application Data

(60) Provisional application No. 60/803,487, filed on May 30, 2006.

(51) Int. Cl.
*H04R 25/00* (2006.01)

(52) U.S. Cl. ..... 381/322; 381/328; 381/418

(58) Field of Classification Search ..... 381/312, 381/315, 322, 324–328, 330, 380, 418; 600/25; 607/56, 57; 181/129, 130, 135
See application file for complete search history.

(56) References Cited

U.S. PATENT DOCUMENTS 4,817,609 A * 4/1989 Perkins et al. ..... 607/56
5,554,096 A * 9/1996 Ball ..... 600/25
5,917,918 A 6/1999 Callahan
6,473,513 B1 * 10/2002 Shennib et al. ..... 381/328
6,707,920 B2 * 3/2004 Miller ..... 381/326
6,879,695 B2 * 4/2005 Maltan et al. ..... 381/315
7,016,512 B1 3/2006 Feeley et al.
7,110,562 B1 9/2006 Feeley et al.
7,139,404 B2 11/2006 Feeley et al.
7,310,426 B2 * 12/2007 Shennib et al. ..... 381/328
2003/0190053 A1 10/2003 Van Halteren
2007/0064966 A1 3/2007 Feeley et al.
2007/0064967 A1 3/2007 Feeley et al.
2008/0095393 A1 4/2008 Klein et al.

OTHER PUBLICATIONS

Sales Literature, Knowles Electronics, Earpiece Outline Drawing (2 pages); CM-23152-000 dated Jan. 8, 2006.
PCT International Search Report for Application No. PCT/US07/69965 dated Sep. 9, 2008.

* cited by examiner

*Primary Examiner*—Huyen D Le
(74) *Attorney, Agent, or Firm*—Fitch, Even, Tabin & Flannery

(57) ABSTRACT

A receiver module for a personal listening device to be fitted in the ear, on the ear, near the ear, or behind the ear, the receiver module having a movable armature, the receiver module comprises a motor assembly and a housing defining a chamber, the housing is made from a material that is corrosion resistant and is biocompatible to human skin contact. The receiver module further comprises at least one motor assembly directly disposed in the chamber. Optionally a communication link adapted to couple or decouple with the motor assembly. At least a portion of the communication link is disposed in the housing.

24 Claims, 11 Drawing Sheets

PERSONAL LISTENING DEVICE

CROSS-REFERENCE TO RELATED APPLICATION

This patent claims benefit under 35 U.S.C. § 119 (e) to U.S. Provisional Application No. 60/803,487, filed May 30, 2006 and entitled Assistive Listening System, the disclosure of which is hereby incorporated herein for all purposes.

BACKGROUND

Various hearing aids and earpiece devices are known in the art. Many take the form of a Behind-the-Ear (BTE), In-The-Ear (ITE), In-the-Canal (ITC), Completely-In-The Canal (CIC), or Receiver-in-the-Ear (RIE) component. In a typical hearing aid, the hearing aid is constructed with a four-piece structure, e.g. internal components for the receiver, receiver housing, surrounding structure, and an ear mold or compliant ear dome/tip. The receiver comprises a housing that is made of metal or a non-biocompatible material. Some wearers may be allergic to metal housing, and the wearer may experience discomfort when the receiver housing is directly in the ear canal.

The tissues covering the bony region of the ear are relatively thin and, therefore, little or no tolerance for expansion exists in this region as compared to the tissues covering the cartilaginous region. Inserting the metal receiver deeply into the ear canal so that it touches the bony region not only damages the tissues in the bony region, but the wearer will experience great pain.

The ear mold or compliant ear dome/tip is attached to the surrounding structure and then inserted into the ear canal for comfort wear. The ear mold and the surrounding structure must be carefully removed in order to reach the receiver, and once the receiver has been repaired or replaced, the receiver is inserted back into the ear mold and the surrounding structure.

The surrounding structure has been used to accomplish several tasks: protect the user from non-biocompatible receiver housing, provide ease of assembling the ear fit device, and protect the electrical and mechanical portions of the device from ear wax, perspiration, and various environmental contaminants.

A disadvantage in using the four-piece structure, e.g. internal components for the receiver, receiver housing, surrounding structure, and ear mold, for the earphone or the hearing aid is that it is very bulky by nature. Also, it is very difficult to design and control the design parameters of the surrounding structure to suit different receiver and hearing aid configurations. It is not suited for low cost mass production. In addition, in some cases, the structure needs to be taken apart in order to repair and or replace the receiver.

BRIEF DESCRIPTION OF THE DRAWINGS

For a more complete understanding of the disclosure, reference should be made to the following detailed description and accompanying drawings wherein.

Figure 1:
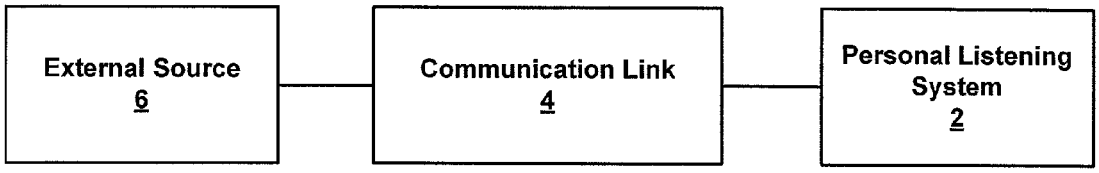
FIG. 1 is a block diagram showing the communication link between a personal listening device and an external device according to various embodiments of the present invention.

Skilled artisans will appreciate that all elements in the figures are illustrated for simplicity and clarity. It will further be appreciated that certain actions and/or steps may be described or depicted in a particular order of occurrence which those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

While the present disclosure is susceptible to various modifications and alternative forms, certain embodiments are shown by way of example in the drawings and, these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

Figure 2:
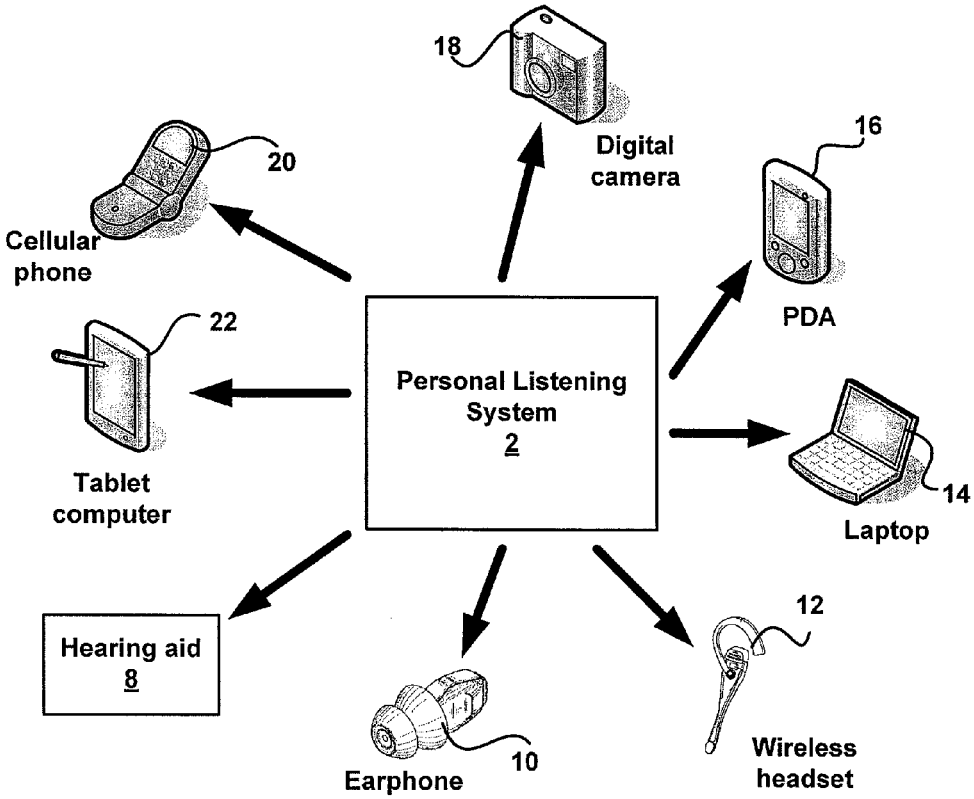
FIG. 2 is a perspective view of a personal listening device that may be utilized in various types of devices according to various embodiments of the present invention.

FIGS. 1-2 illustrate the flexibility and usefulness of a personal listening device 2 to be fitted in the ear, on the ear, near the ear, or behind the ear, in accordance with one or more of the herein described embodiments. The personal listening device 2, which may be virtually any personal listening device or system such as a hearing aid 8, an earphone 10, a headphone (not shown), a wireless headset 12, an insert earphone (not shown), and the like. Other examples of devices are possible. An optional communication link 4, which can be a direct wired link or a wireless link, couples the personal listening device 2 to an external device 6. The external device 6 may be virtually any electronic device, a gaming device and the like such as a computer (e.g. a desktop, a laptop 14, a notebook, a tablet 22, a hand-held computer, a Personal Digital Assistant (PDA) 16, etc), a communication device (e.g. cellular telephone 20, a web-enabled cellular telephone, a cordless telephone, a pager, etc), a computer-related peripheral (e.g. a printer, a scanner, a monitor, etc), an entertainment device (e.g. a television, a radio, a stereo, a tape and/or compact disc player, a digital layer 3 (MP3) player, etc), a digital camera 18 and the like. Other examples of devices are possible. The external device 6 needs only to be capable of or configured to be capable of communication over one or more public or private communication networks.

The communication link 4 transmits and receives data or signals over the air (in a wireless mode) or over the wire (in a wired mode).

Figure 3:
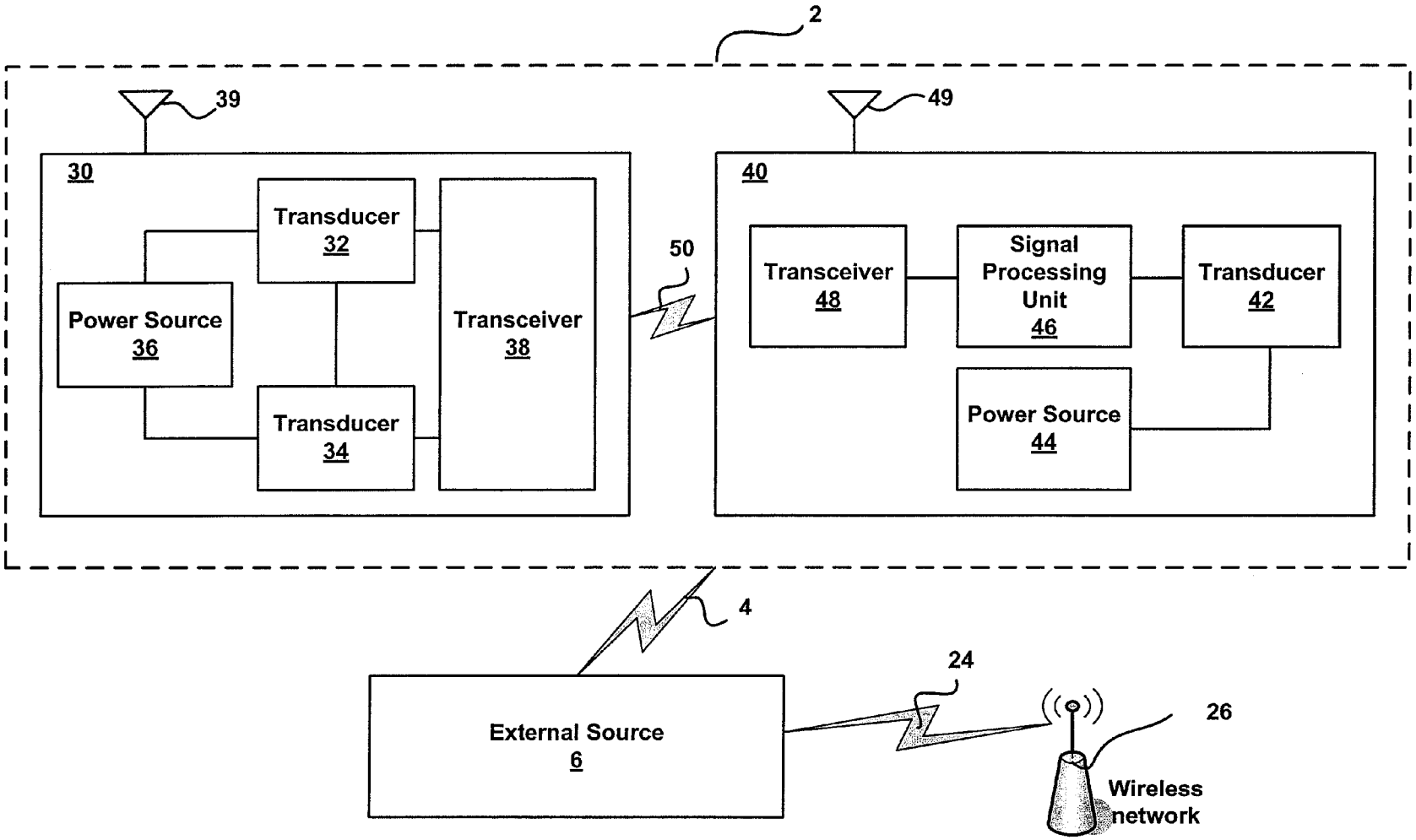
FIG. 3 is a detailed block diagram showing an interface between a personal listening device and an external device in accordance with various embodiments of the present invention.

FIG. 3 illustrates a detailed block diagram of a personal listening device 2. The personal listening device 2 comprises a first module 30, a second module 40, and a communication link 50 adapted to couple or decouple the first and second modules 30, 40. In this example, the first and second modules 30, 40 may be a Receiver-in-the-Ear (RIE), a Behind-the-Ear (BTE), In-the-Ear (ITE), In-the-Canal (ITC), Completely-in-the-Canal (CIC) component or combination thereof. Other examples of devices are possible. Alternatively the modules 30, 40 may be integrated to form a single device. More aspects about the formation of the system 2 are described elsewhere in this specification. At least a portion of the personal listening device 2 may be optionally coupled to an external device 6 via a second communication link 4 adapted to couple or decouple the personal listening device 2 and the external device 6. The first and second communication links 50, 4 may be virtually any communication link, and for example, the communication links 50, 4 may be constructed and defined or configured to operate in a wired mode, a wireless mode, or both wired and wireless modes to transmit and receive data or signals over the air or over the cable. If the system 2 and the external device 6 are constructed in a wireless mode to radiate signals in the radio frequency (RF) range for instance, the system 2 may be at a remote location with respect to the external device 6. Alternatively, the system 2 and the external device 6 may be converted to a wired mode by means of plugging the wired link 50 and/or 4.

The module 30 may include one or more devices, e.g. 32 or 34, to deliver an acoustic energy directly to the ear canal. The devices 32, 34 may be a receiver, a dual receiver, a microphone/receiver, or a microphone with a dual receiver, depending on the desired applications. Other types of electroacoustic transducers are possible. In this example, the receiver may be a silicon (micro-electromechanical machined, MEMS) receiver, a balanced armature receiver, a bone-conduction receiver, or combinations thereof for the conversion of an electrical audio frequency signal to an acoustic or vibratory signal, depending on the desired applications. Alternatively, the devices 32, 34 may be selected to have virtually any frequency response. For example, the devices 32, 34 may be low-range frequency (LF) receivers, mid-range frequency (MF) receivers, high-range frequency (HF) receivers, or a combination thereof. The microphone may be a silicon (MEMS) condenser microphone, an electret microphone, an omni-directional microphone, a directional microphone, a dynamic microphone, or a monitor microphone such as the monitor microphone disclosed in U.S. patent Ser. No. 11/382,318, filed on May 9, 2006, the disclosure of which is herein incorporated by reference in its entirely for all purpose, depending on the desired applications. Other types of microphones are possible. The module 30 may further include other electronic components such as a power source 36, a transceiver 38 with an antenna 39, and a processor (not shown). The transceiver 38 is configured to send and receive signals between the modules 30, 40 via the wireless communication link 50. The power source 36 is coupled to the rest of the electronic components to provide power. The processor (not shown) may be a signal processing unit, a speech processing unit, a multi-function processing unit or the like, and it is coupled between the transducers 32, 34 and the transceiver 38. Other types of processor are possible. The antenna 39 is used to transmit and receive signals from the transceiver 38. The antenna 39 may be external or internal to the module 30. The antenna 39 may serve as part of the communication link. Alternatively, the antenna 39 may serve as part of the retrieval member to remove the module 30 from the ear.

The module 40 includes at least one device 42. The device 42 may be a microphone to receive sound from the outside environment. Alternatively, the device 42 may be multiple devices such as a microphone/receiver, a dual microphone, or a plurality of microphones. The module 40 may further include other electronic components such as a power source 44, a signal processing unit 46, and a transceiver 48 with an antenna 49. The microphone 42 converts acoustic signals into electrical signals and transfers such electrical signals to the signal processing unit 46 for processing before such signals are transmitted to the module 30 via the optional transceiver 48. Like the transceiver 38 of module 30, the transceiver 48 is in operative communication with the transducer 42 and/or the external device 6 and is configured to transmit and receive wireless communication in accordance with any suitable protocol such as Bluetooth, Ultra-Wideband (UWB), Home Radio Frequency (HomeRF), Digital Enhanced Cordless Telephone (DECT), Personal Handy System (PHS), wireless LAN (WLAN), or other open or proprietary protocols now known or later developed that are capable to couple between the modules 30, 40 and/or the external device 6. The antenna 49 is used to transmit and receive signals from the transceiver 48. The antenna 49 may be external or internal to the module 40. The power source 44 is coupled to the rest of the components of the module 40 to provide power. Other circuitry such as a speech processing unit, switching means, digital audio compression and depression, oscillator-FM modulator, multipliers, expender, FM detector, down-converter and intermediate frequency (IF), or the like now known or later developed may be provided in the modules 30, 40 to perform certain operations.

The external device 6, such as a mobile phone, has the capability to send and receive a wide variety of audio signals between the system 2 either by the wired link or a wireless link 4, 24 and a wireless network 26. In turn, it is connected to the public switched telephone network (PSTN). The wireless network 26 may be a cellular network, a paging network, or the like. Other types of network are possible. The cellular network 26 includes common data service network protocols for sending and receiving information to and from the mobile phone such as AMPS (analog signal), Time Division Multiple Access (TDMA), Code Division Multiple Access (CDMA), Global System for Mobile Communications (GSM), Personal Handy System (PHS), Digital Enhanced Cordless Telephony (DECT), General Packet Radio Service (GPRS), or other open or proprietary wireless data service protocols now known or later developed. Alternatively, the external device 6 may be other types of electronic devices (See FIG. 2) that do not require communication with a wireless network.

Figure 4:
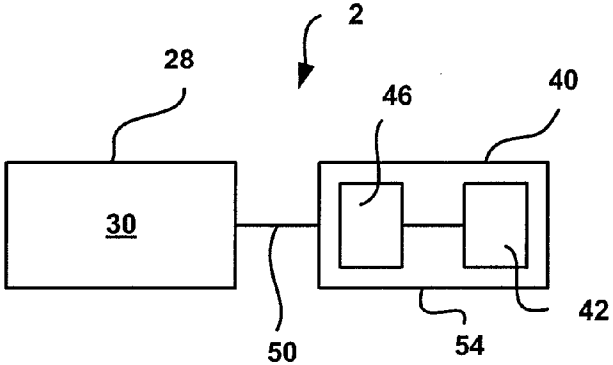
FIG. 4 is a simplified block diagram of another exemplary personal listening device in accordance with various embodiments of the present invention.

FIG. 4 illustrates a simplified block diagram of a personal listening device 2. In this example, module 30 is electrically coupled to a second module 40 via a wired communication link 50. The module 30, which is capable of converting amplified signals to acoustic signals before transmitting to the ear canal of a user, comprises an acoustic assembly and a motor assembly that is attached to the acoustic assembly via a coupling assembly. The assemblies are disposed within a housing 28. The housing 28 may be made of any biocompatible material and has no adverse effect on the surrounding tissue. More aspects about the formation of the module 30 will be discussed in greater detail herein. In this example, the module 30 may be a RIE, CIC, ITC, ITE, or any body-worn device. Other types of listening devices are possible. The module 40 comprises a microphone 42 and a signal processing unit 46 disposed in a housing 54. Alternatively, the microphone 42 may be separated from the signal processing unit 46 and is located outside the housing 54. A second communication link (not shown) couples the microphone 42 to the module 40 and/or the module 30. A microphone 42 comprises a housing (not shown) made of any bio-compatible material that is used to encapsulate the internal components and is then inserted into the auditory canal. The module 40 may be a BTE, ITE, or ITC. Other types of listening devices are possible. More than one microphone may be provided. The microphone 42 receives acoustic signals from the external environment and converts such signals into electrical signals before the signals are transmitted to the signal processor unit 46. The signal processor unit 46 then amplifies the signal received from the microphone 42 and delivers the processed signal to the module 30 via the communication link 50. More aspects about the formation of the communication link 50 are described elsewhere in this specification.

Figure 5:
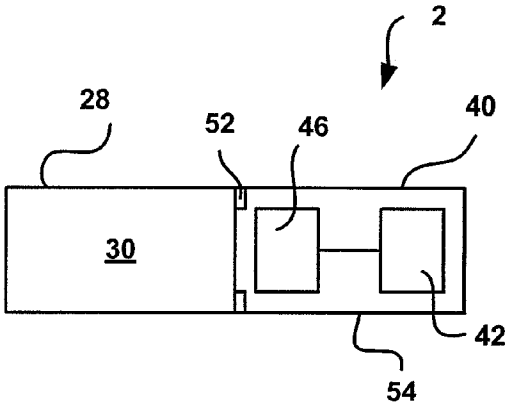
FIG. 5 is a simplified block diagram of another exemplary personal listening device in accordance with various embodiments of the present invention.

FIG. 5 illustrates a simplified block diagram of a personal listening device 2. In this example, the first and second modules 30, 40 are integrated into a single unit. The module 30 capable of converting amplified signals to acoustic signals before transmitting to the ear canal of a user comprises an acoustic assembly and a motor assembly that is attached to the acoustic assembly via a coupling assembly. The assemblies are disposed within a housing 28. The housing 28 may be made of any biocompatible material and has no adverse effects on the surrounding tissue in the ear canal. At least a portion of the housing of the receiver module is allowed to be in direct contact with the skin of the ear canal. The module 40 comprises a microphone 42 and a signal processing unit 46. More than one microphone may be included. The microphone 42 and the signal processing unit 46 are disposed in a housing 54. The housing 28 comprises a connecting member 52 configured to attach the plastic body 28 to the housing 54. Alternatively, the housing 28 of the module 30 has a first end adapted to couple and decouple with the housing 54 of the module 40 by mechanical fastening, crimping, welding, adhesive bonding, or any other suitable attachment arrangement now known or later developed. The module 30 or 40 is easily removed and replaced if the module 30 or 40 fails for any reason. In this example, the system 2 may be a CIC, ITC, ITE, BTE, or RIE component.

Figure 6:
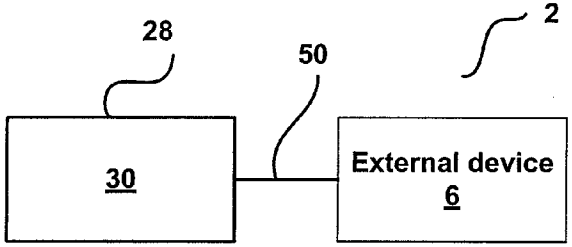
FIG. 6 is a simplified block diagram of another exemplary personal listening device in accordance with various embodiments of the present invention.

FIG. 6 illustrates a simplified block diagram of a personal listening device 2. In this example, a module 30 is a listening device. The listening device 30 may be an earphone, an earplug, a headphone, a wireless earphone, a wireless headset, a wireless headphone, an insert earphone and the like. Other types of devices are possible. The listening device 30 comprises at least one earphone to be positioned in an ear canal. The earphone 30 may be electrically coupled to an electronic device 6 via a suitable communication link 50 that provides audio signals to the earphone 30. Alternatively, a user input device (not shown) may be coupled to the earphone 30 to perform different functions. The earphone 30 comprises a plastic body 28 to be worn by a user. An acoustic assembly and a motor assembly coupled to the acoustic assembly via the coupling assembly are collectively disposed within the housing 28. An outer surface of the body 28 can take various forms or shapes adapted for fitting to the user's ear. Alternatively, an ear impression, a sealed mold, an ear tip, an ear mold, an ear dome, an ear tube, an ear mold, an ear bud, an ear cone, or an ear plug of varying sizes and shapes, or the like may be used to cover at least a portion of the body 28. This allows the user to wear the listening device 30 comfortably for an extended period of time. The body 28 with or without the ear tip provides a good seal in the ear. Alternatively, the body 28 may be smaller in size than the interior of the auditory canal whereby the body 28, with or without the ear tip, does not occlude the ear canal.

In this example, the external device 6 may be a communication device, an audio device, a gaming device, an entertainment device, or combination thereof. Other types of devices are possible.

Figure 7A:
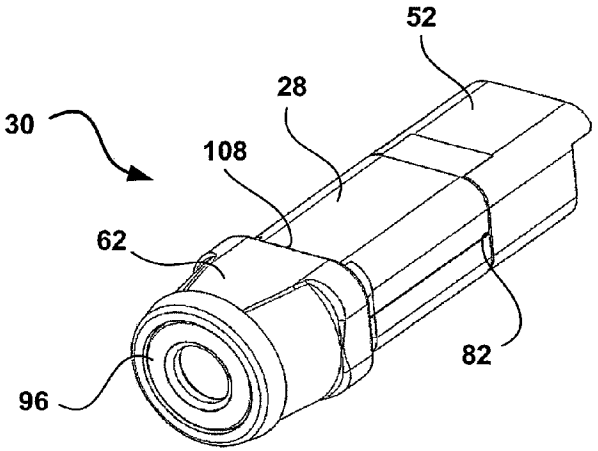
FIGS. 7A-7C are different views of another exemplary personal listening device in accordance with various embodiments of the present invention.
Figure 7C:
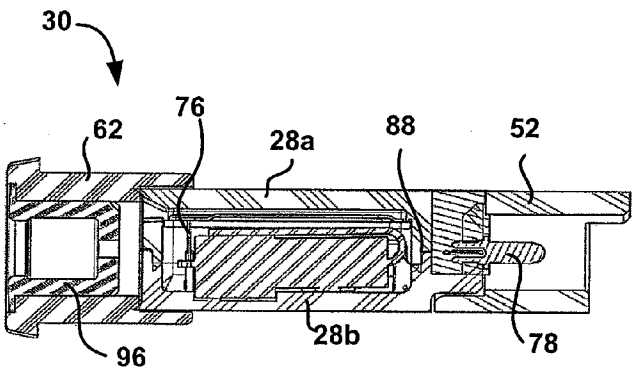
Figure 7B:
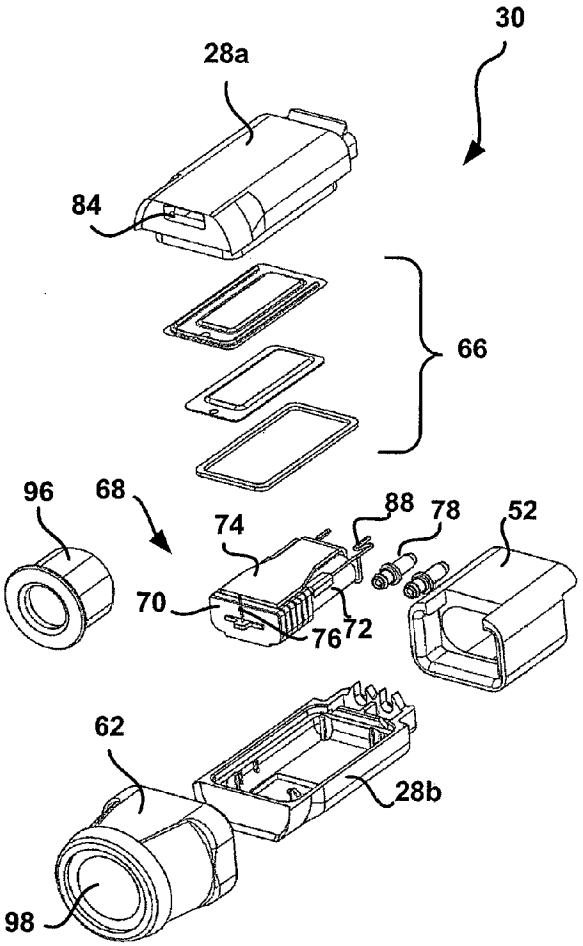

FIGS. 7A-7C illustrate different views of a personal listening device 2. In this example, the system 2 is configured to generate acoustic energy in the ear canal of the wearer. The system 2 can function on either ear. In this example, the system 2 is a receiver to drive an acoustic signal directly to the ear canal. The system 2 comprises a housing 28, a connector assembly 52, and a tube assembly 62. The housing 28 comprises a top housing 28*a* and a bottom housing 28*b*. Although the top housing 28*a* and the bottom housing 28*b* are depicted, it is possible to add additional structures. For example, a spacer may be added between the top housing 28*a* and the bottom housing 28*b* to increase the overall height and volume of the housing 28 or the bottom housing 28*b* and the top housing 28*a* may be molded as a single structure. A chamber 64 is formed within the housing 28 to receive a motor assembly 68. The chamber 64 may generally be shaped to correspond to the shape and configuration of the assemblies 66, 68 but may be formed to compliment the various shape of the different examples, including a roughly square shape, a cylindrical shape or other desired geometry. As shown, the chamber 64 has a rectangular in cross-sectional shape. In addition, the scale and size of the chamber 64 may vary based on the intended applications, operating conditions, required components, etc. The outer surface of the housing 28 can take various forms or configurations adapted for fitting to the user's ear. The housing 28 may be shaped to fit into the external auditory canal without blocking the canal. Alternatively, the housing 28 may be designed to comfortably fit in the user's ear and yet provides a good seal. The housing 28 may be manufactured from any type of moldable or formable material that is corrosion resistant and bio-compatible for skin contact, including plastic, polycarbonate, nylon, liquid crystal polymer (LCP), PEEK, or any other similar materials. Alternatively, part of the housing 28 may be made of magnetically soft steel, such as metal injection molded material, that is capable of providing electromagnetic shielding or to function as part of the magnetic return path for the motor assembly 68. Such material may be provided to the inner wall of the housing 28, between layers of the bio-compatible, corrosion-resistant material, or outer wall of the housing 28. Yet in another example, the housing 28 may be made of any material, including, but is not limited to Acetal Copolymer or Homopolymer (POM) (Delrin), Acrylic (PMMA), Acrylonitrile Butadiene Styrene (ABS), Cellulose Acetate (CA, CB, CP), Polyamide (Nylons), Polyimide (Kapton), Polycarbonate (PC) (Lexan), Polyethylene Terephthalate (PET), Polyetherimide (PEI) (Ultem), Polyetheretherketone (PEEK), Polyethylene, Polyphenylene Oxide (PPO) (Noryl), Polyphenylene Sulphide (PPS), Polypropylene (PP), Polystyrene, Polyvinyl Chloride (PVC), Styrene Acrylonitrile (SAN/ASA), Polyphtalamide (PPA), Polysulphone, polyphenylsulfone (Radel), polybutylene terephthalate (PBT) (Pocan), Polyphthalamide (PPA), Fluoropolymers, Polyarylate, Silicone, or the like. Material may be a blend or alloy of these materials. The material may or may not include additives for providing strength and expansion control such as glass content, carbon fiber, or the like. Other materials for providing one or more features, including electrical conductivity, magnetic conductivity, UV stabilization, moisture absorption, moldability, chemical resistance, temperature resistance, flexibility, durability, and hardness, may or may not be added to the base material as disclosed above. Other types of materials are possible. An optional non-biocompatible thin film or layer (not shown) may be provided to the housing 28 such that at least a surface of the housing is covered by the film or layer. Alternatively, the housing 28 comprises alternating layers of material, at least one layer of biocompatible material and at least one layer of non-biocompatible material. In another example, the housing 28 comprises an innermost layer that is made of biocompatible material, and at least a portion of the inner surface is provided with a non-biocompatible thin film or layer. The thin film may be made of any material that enhances electromagnetic performance, adhesive characteristics, corrosion characteristics, and environmental protection such as copper, gold, epoxy, primers, or sealant. Alternatively, other types of thin film used for surface treatments in order to enhance adhesion of parts, sealants to encapsulated and protect parts, paints, treatments, thin films for decorative or other reasons may be used. Unlike previous listening devices, the overall size of the module 2 is reduced and a second housing, also known as a surrounding structure is no longer required.

The motor assembly 68 comprises a drive magnet (not shown), a magnetic yoke 70, a coil 72 with or without a bobbin, an armature 74, and a coupling assembly 76. The device 2 further comprises an acoustic assembly 66. The acoustic assembly 66 may be a single layer diaphragm assembly, a multiple layer diaphragm assembly, or the like. The acoustic assembly 66 may be manufactured in a variety of shapes and sizes that may or may not correspond to the chamber 64 and/or the motor assembly 68. For example, the acoustic assembly 66 may be wider and longer or may be narrower and shorter than the motor assembly 68. More aspects about the configuration of the acoustic assembly 66 are described elsewhere in this specification. The acoustic assembly 66 divides the chamber 64 into a back volume 100 and a front volume 102.

The coupling assembly 76 may be a drive rod, a linkage assembly, a plurality of linkage assemblies, or the like. The drive magnet (not shown) may be made of a hard magnetic material such as Ferrite, AlNiCo, Samarium-Cobalt, Neodymium-Iron-Boron, or of any other similar materials. Other types of materials are possible. It will be understood that virtually any magnet shape or configuration suitable for the desired application may suffice. The magnetic yoke 70 may be made of a permeable, soft magnetic material, including Nickel-Iron, Nickel-Iron-Molybdenum, steels, cobalt-iron-vanadium, or any similar alloys and materials. Other types of materials are possible. The magnetic yoke 70 may be formed to compliment the various shape and size of the different examples. As shown, the magnet is fixedly attached to the inner wall of the magnetic yoke 70. Although the magnet and the magnetic yoke are a two-piece structure, it is possible to construct the magnet and the yoke 70 as a single unit. The armature 74 is generally U-shaped. One of ordinary skill in the art will appreciate that the armature 74 may be E-shaped, Y-shaped, or of a different configuration and size suitable for the desired application. The coil 72 is made of electrically conductive materials having thickness and a plurality of turns. In alternate examples, the coil may be made of alternating layers of insulating and conducting materials. Other types of materials are possible. As shown in FIG. 7B, the coil 72 is sized to conform to the shape of the chamber 64, but may be produced in a variety of shapes and sizes that may or may not correspond to the chamber 64. For example, the coil 72 may be an oval shape having a dimension smaller than the chamber 64 while the chamber 64 may be manufactured having a rectangular shape. An optional acoustic structure and/or an electrical structure are disposed in the housing 28. The structures may be acoustic compliances, acoustic resistances, acoustic inertances, damping, acoustical filters, chambers, tubes, ports, vents, electrical filters, or combinations thereof.

In this example, the armature 74 comprises a movable leg extending through the coil 72 and the magnetic yoke 70 and a fixed leg secured outside the magnetic yoke 70 by any known technique. One end of the coupling assembly 76 is attached to a free end of the movable armature 74 by any known technique and the opposite end of the coupling assembly 76 is attached to the acoustic assembly 66 by any known technique. Alternatively, the diaphragm 66 may be coupled directly to the movable leg of the armature 74. Two wires 76 extend from the coil 72 and are electrically coupled to pins 78 which protrude through a rear wall 80 of the chamber 64. Alternatively, the wires 76 are electrically coupled to a communication link (not shown). Locking members 104 formed on the bottom housing **28*b* secure the pins 78 in proper position and a strain relief 52 for protecting the wires 76 and the pins 78 secures and retains the communication link. The wires 76 receive an electrical input signal that is converted by the acoustic assembly 66 and the motor assembly 68 to an acoustic signal which is broadcast through an outlet 84. As shown in FIGS. 7B-7C, the outlet 84 is provided on the top housing 28*a* by any known technique and is directly connected to the back volume 100 to allow acoustic energy to be transmitted to the user. Although one outlet 84 is depicted, it is possible to provide an additional outlet or acoustic path. The communication link 50 may be made of similar material to the housing 28. Use of other types of materials that posses sufficient structural properties and rigidity is possible. The housing 28 has a first end 82 adapted for mechanical connection with a first end 106 of the connector assembly 52. If the connector assembly fails for any reason, the connector assembly is easily removed and replaced with a functional connector assembly 52. The strain relief 52 may be posed of sufficient structural properties and yet rigidity for insertion and removal of the system 2 from the auditory canal without separating the strain relief 52 from the housing 28. Once the acoustic assembly 66 and the motor assembly 68 are held in place in the chamber 64, the top and bottom housing 33*a*, 33*b*** are then fixedly attached together by any known technique.

As shown, the tube assembly or the channel 62 has an opening 98 adapted for accommodation of the wax screen 96 that is positioned in the transmission path of sound that is emitted from the outlet 84 by the assemblies 66, 68. The wax screen 96 is used to protect the internal components from damage. Like the connector assembly 52, the tube portion 62 may be made of similar material as the housing 28. Use of other types of material is possible. The tube portion 62 is coupled to a second end 108 of the housing 28 by any known technique. The tube assembly 62 may be manufactured in a variety of lengths and dimensions to modify the frequency response of the module 30. In certain applications, the tube assembly 62 is not required and the acoustic assembly 66 via the outlet 84 is exposed to the ear canal for direct transmission of sound into the user's ear. An optional wax screen may be provided to cover the outlet 84 against cerumen or ear wax. Alternatively, at least one aperture may be formed on the housing 28 to provide a flow path for cleaning liquids that are used when flushing out the front volume 102 and cleaning the acoustic assembly 66. Wax protection measures such as removable or cleanable wax grids, wax plungers, or the like may be inserted in the acoustic path between the acoustic assembly 66 and the ear canal. Alternatively, a portion of the housing 28 may be removed to clean, service, or rework the internal components.

Figure 8:
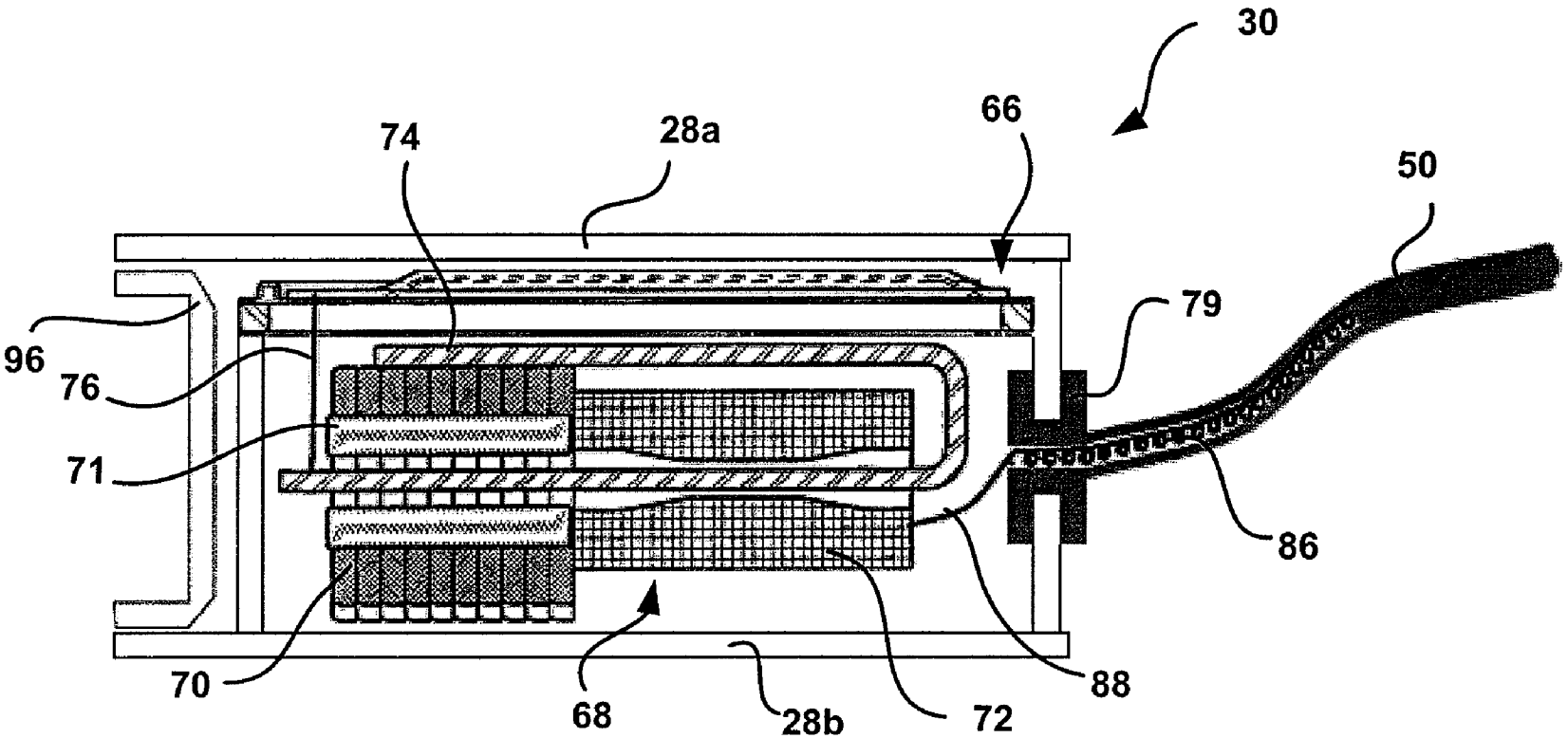
FIG. 8 is a cross-sectional view of another exemplary personal listening device in accordance with various embodiments of the present invention.

FIG. 8 illustrates a cross-sectional view of a personal listening device 2. FIG. 8 is similar in construction to the system 2 in FIG. 7C. As mentioned earlier, a strain relief member 79 may be formed as part of a communication link 50 is provided at the rear wall 80 of the housing 28. The strain relief member 79 is provided for retaining the wire 76 and to prevent accidental removal of the communication link 50 from the motor assembly 68. The communication link 50 preferably is stretchable, bendable and preferably retains the conductor 86 in position. As shown, the conductor 86 may be wound as a helix to prevent breaking when the cable is stretched. An optional retrieval member may be provided to the system 2 for removal of the system 2 from the ear canal. The retrieval member may be formed as part of the communication link 50. A portion of the communication link 50 extending from the housing 28 may be hollow, providing acoustical measures to modify the frequency response of the system 2.

Figure 9C:
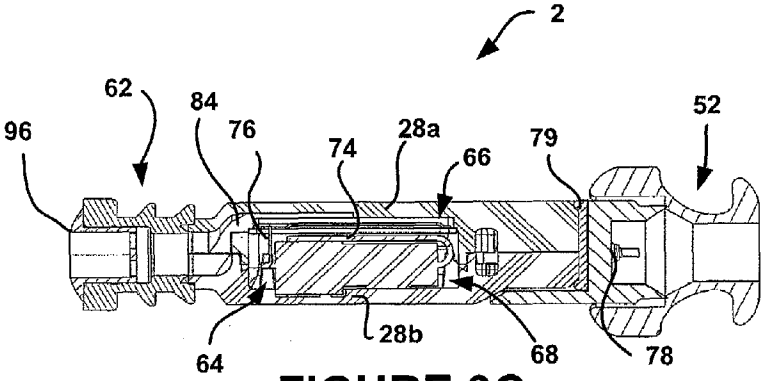
FIGS. 9A-9C are different views of another exemplary personal listening device in accordance with various embodiments of the present invention.
Figure 9B:
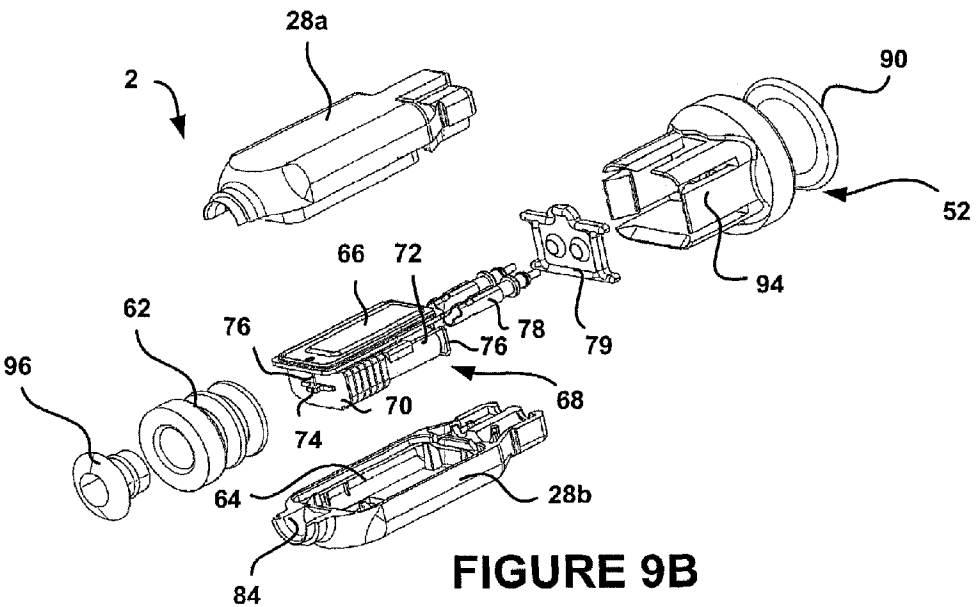
Figure 9A:
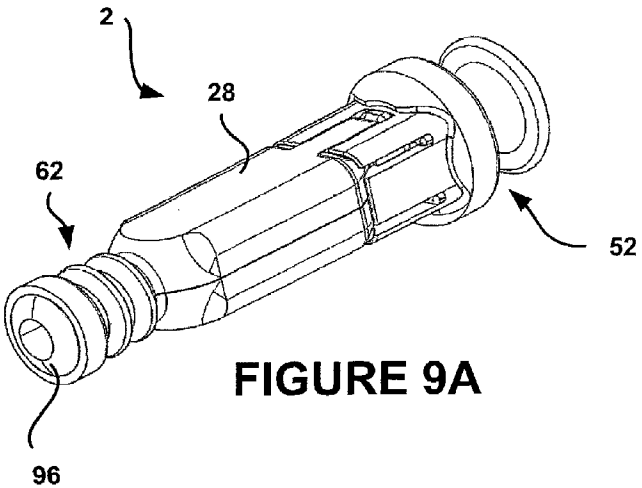

FIGS. 9A-9C illustrate different views of a personal listening device 2. FIGS. 9A-9C are similar in construction to the system 2 of FIGS. 7A-7C except that a short tube 84 serving as an acoustic outlet protrudes from a second end 108 of the housing 28. The short tube 84 is coupled to the inner wall of a tube assembly 62, and a wax screen 96 is attached in the tube assembly 62 opposed to the outlet 84 by any suitable method of attachment. An optional dampening or an acoustic labyrinth may be provided within the tube assembly for tuning an acoustic response. Alternatively, the wax screen 96 may be coupled directly to the outlet 84 if the tube assembly 62 is not provided. A connector assembly 52 comprises a plurality of flange 94 adapted for coupling or decoupling the housing 28, is mounted to the outer wall of the housing 28 such that a portion of the housing 28 is covered by the connector assembly 52.

Figure 10B:
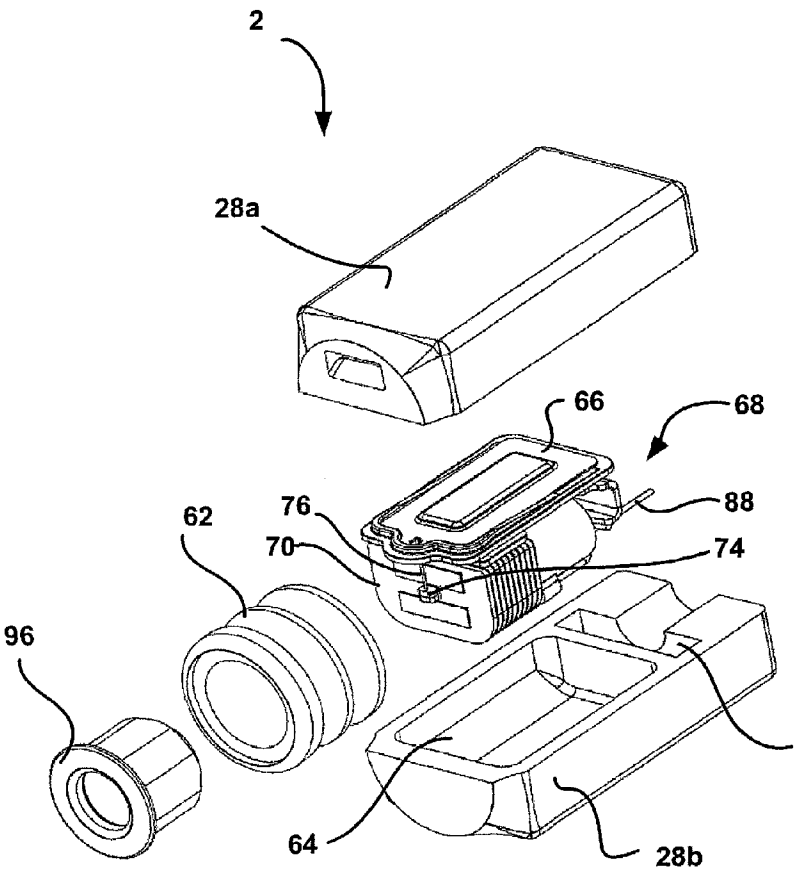
FIGS. 10A-10C are different views of another exemplary personal listening device in accordance with various embodiments of the present invention.
Figure 10A:
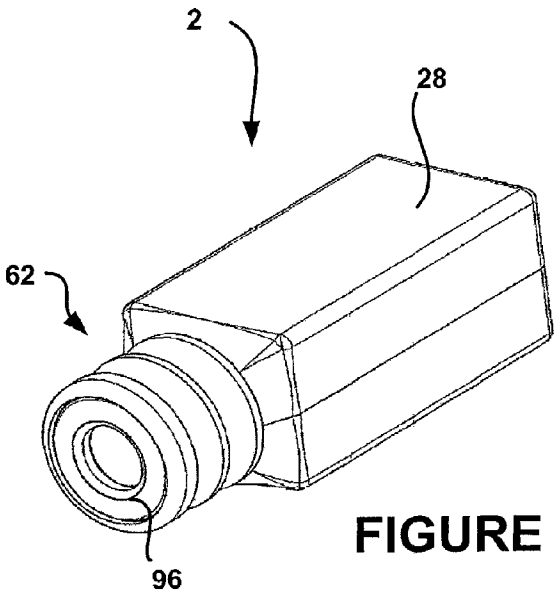
Figure 10C:
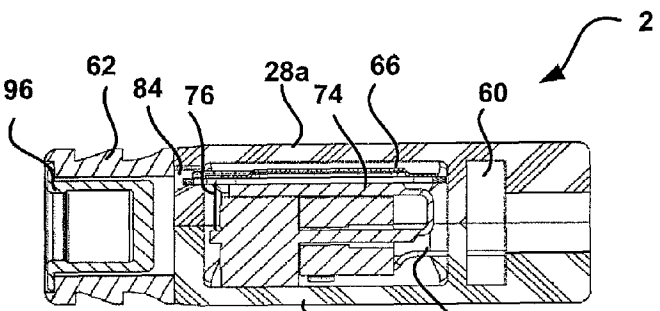

FIGS. 10A-10C illustrate different views of a personal listening device 2. FIGS. 10A-10C are similar in construction to the system 2 of FIGS. 9A-9C. In contrast to the system 2 in the foregoing figures, a tube assembly 62 adapted to couple or decouple is provided to the front wall of a housing 28. A second chamber 60 is provided to fixedly attach the wire 88 to the second chamber 60 by any known technique. A first end of a communication link 50 is electrically coupled to the wire 88 and a second end (not shown) of the communication link 50 is connected to the external device (not shown).

Figure 11B:
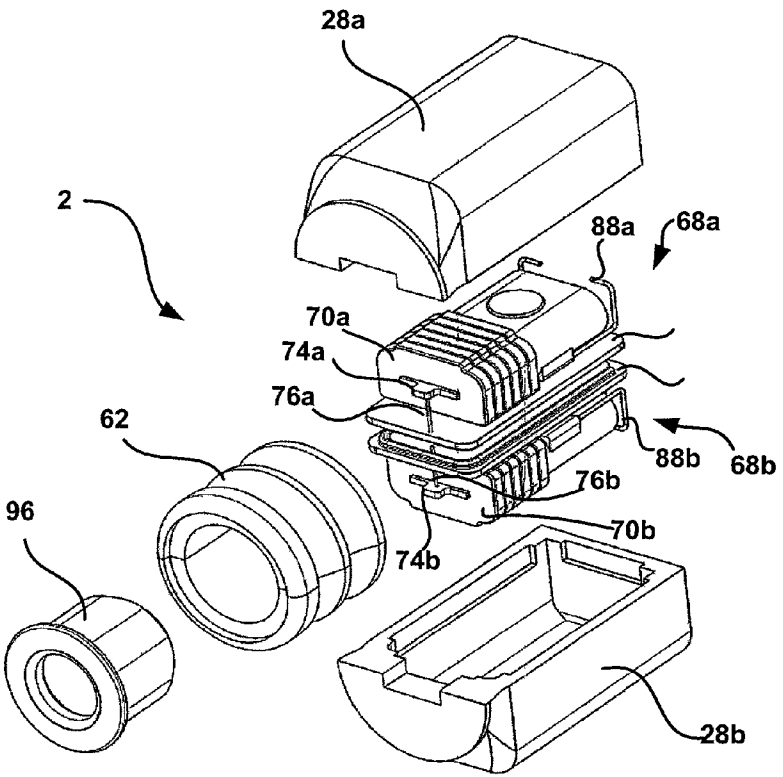
FIGS. 11A-11C are different views of another exemplary personal listening device in accordance with various embodiments of the present invention.
Figure 11A:
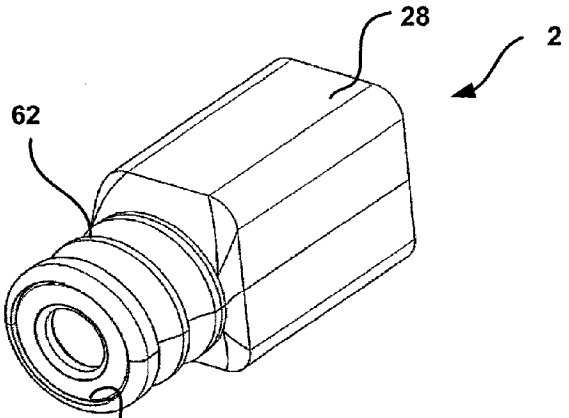
Figure 11C:
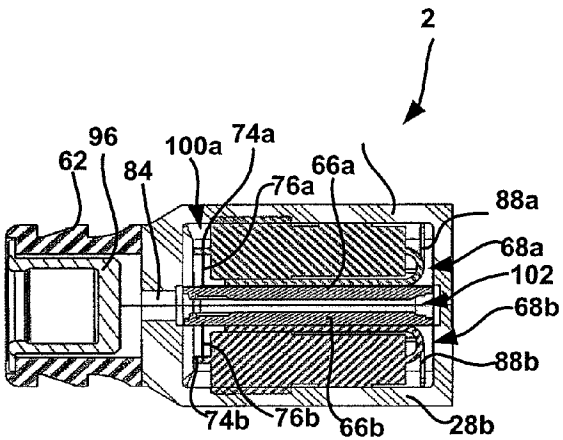

FIGS. 11A-11C illustrate different views of a personal listening device 2. In contrast to the system 2 in the foregoing figures, the system 2 comprises two acoustic assemblies 66*a*, 66*b* and two motor assemblies 68*a*, 68*b*, collectively disposed in a housing 28. As shown, the acoustic assemblies 66*a*, 66*b* are arranged such that the assemblies 66*a*, 66*b* face each other and share a common front volume 102. A first back volume 100*a* and a second back volume 100*b* are formed in the chamber 64, wherein the first motor assembly 68*a* is disposed in the first back volume 100*a* and the second motor assembly 68*b* is disposed in the second back volume 100*b*. Alternatively, the motor assemblies 68*a*, 68*b* may share a common back volume 100 and the acoustic assemblies 66*a*, 66*b* separate the chamber 64 to form first and second back volumes 102*a*, 102*b*. An optional structure (not shown) may be provided to separate the assemblies 66*a*, 66*b*, 68*a*, 68*b* such that two chambers 64*a*, 64*b* are formed. The assemblies 66*a*, 66*b*, 68*a*, 88*b* no longer share a common volume. The assemblies 66*a*, 68*a* are disposed in the first chamber 64*a* and the assemblies 66*b*, 68*b* are disposed in the second chamber 64*b*.

Figure 12:
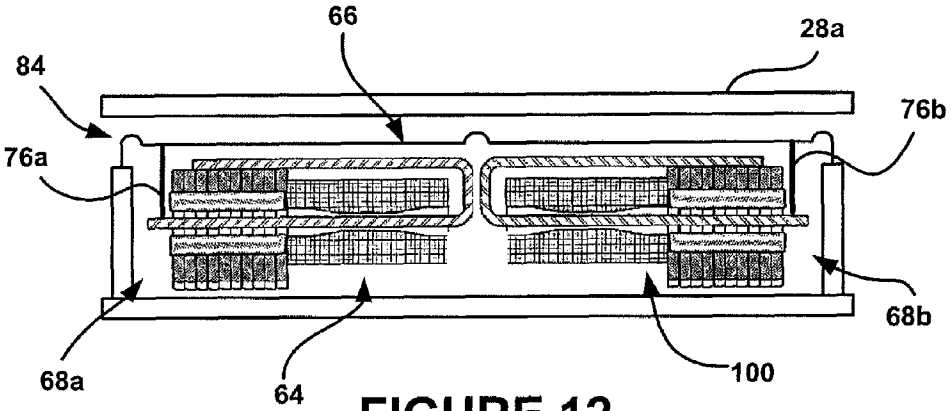
FIG. 12 is a cross-sectional view of another exemplary personal listening device in accordance with various embodiments of the present invention.

FIG. 12 illustrates a cross-sectional view of an assistive system 2. In contrast to the system 2 in FIG. 11, the system 2 comprises two motor assemblies 68*a*, 68*b* and an acoustic assembly 66. The ends of the acoustic assembly 66 may be hinged to the side walls of the housing 28, the inner walls of the housing 28, or other support members provided within the housing 28. The motor assemblies 68*a*, 68*b* are coupled to the acoustic assembly 66 by any known technique. In this example, the coupling assembly 76*a* is positioned at one end of the acoustic assembly 66 (close to the front wall of the housing 28), and the coupling assembly 76*b* is positioned at the opposite end of the acoustic assembly 66 (close to the rear wall of the housing 28). The motor assemblies 68*a*, 68*b* share a common back volume 100, and the diaphragm assembly 66 vibrates in response to the assemblies 68*a*, 68*b*. At least one sound port may be provided to directly connect the front volume 102 to allow acoustic energy to be transmitted to the user. In this example shown, two ports 84*a*, 84*b* are provided to roll off occlusion effect and low frequency. Alternatively, a second sound port may be provided in communication with the back volume 100 for pressure equalization between the back volume 100 and the surrounding.

Figure 13B:
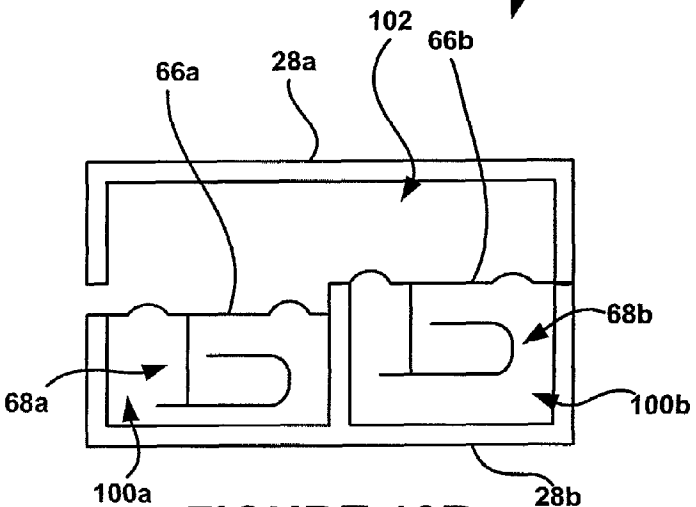
FIGS. 13A-13B is a cross-sectional view of another exemplary personal listening device in accordance with various embodiments of the present invention.
Figure 13A:
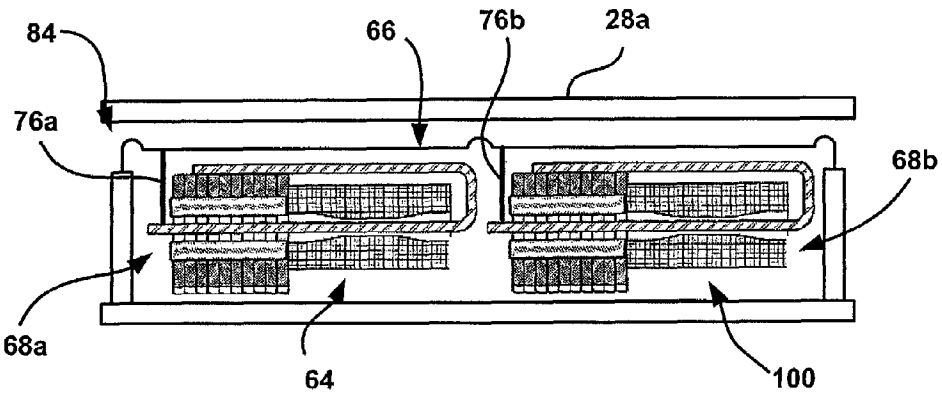

FIGS. 13A-13B illustrate cross-sectional views of an assistive system 2. Unlike from FIG. 12, the coupling assembly 76*b* is positioned in the mid portion of the acoustic assembly 66 within the chamber 64. In this configuration, the coupling assemblies 76*a*, 76*b* provide further support to the acoustic assembly 66 when the acoustic assembly 66 is excited by the motor assemblies 68*a*, 68*b*. Alternatively, an optional structure is provided to separate the motor assemblies 68*a*, 68*b* so that the assemblies 68*a*, 68*b* no longer share a common back volume 100. Two front volumes 100*a*, 100*b* are illustrated in FIG. 13B, wherein the motor assembly 68*a* corresponds to the first back volume 100*a* and the motor assembly 68*b* corresponds to the second back volume 100*b*. A common front volume 102 is formed and shared by the first and second acoustic assemblies 66*a*, 66*b*.

Figure 14:
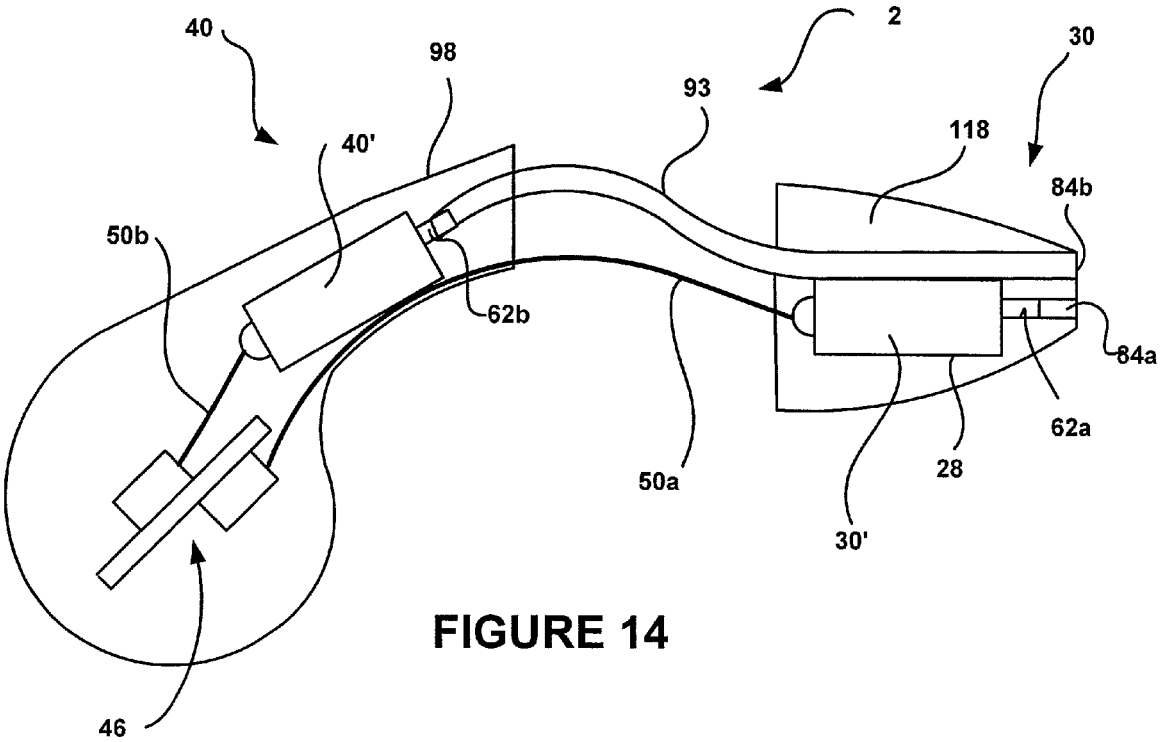
FIG. 14 is a sectional view of another exemplary personal listening device in accordance with various embodiments of the present invention.

FIG. 14 illustrates a sectional view of an assistive system 2. The system 2 comprises a first module 30, a second module 40, and communication links 50*a*, 50*b* between the modules 30, 40. The first module 30 includes a high frequency (HF) transducer. Also, an optional ear mold 118 may be provided such that a portion of the module 30 is disposed in the ear mold 118. A sound outlet tube 62*a* coupled to the HF transducer 30 is mated with a first sound port 84*a* formed within the ear mold 118. The second module 40 includes a low frequency (LF) transducer and a driving circuit assembly 46, disposed within a housing 54 of the second module 40. The driving circuit assembly 46 electrically couples the LF transducer 40 to the HF transducer 30. The LF transducer 40 includes a sound outlet tube 62*b* that is coupled to a LF acoustic transmission tube 93. The LF tube 93 may function to filter LF signals emitted from the LF transducer 40. The HF transducer 30 is not driven by a substantially LF input signal. As shown, the LF tube 93 extends from the second module 40 to the first module 30 such that a portion of the LF tube 93 is retained in a hollow section that is formed within the ear mold 96. The end portion of the LF tube 93 is mated with a second sound port 84*b* of the ear mold 118. The communication link 50*a* electrically couples the first module 30 to the circuit 46, and the communication link 50*b* electrically couples the second module 30 to the circuit 46.

Figure 15:
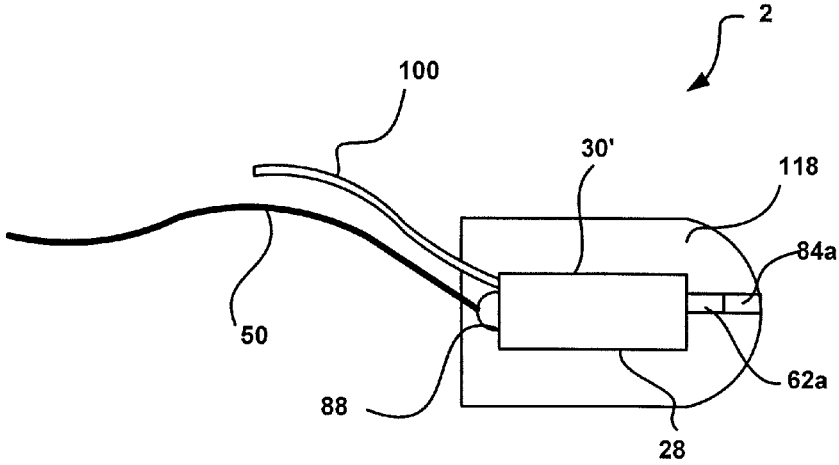
FIG. 15 is a sectional view of another exemplary personal listening device in accordance with various embodiments of the present invention.

FIG. 15 illustrates yet another example of a personal listening device 2. A first module 30 of the system 2 includes a transducer and a sound tube 62*a* attached to the transducer 30, disposed within an ear mold 118. An acoustic tube 93 coupled to the housing 28 may function as a hollow tube to provide LF response modification. Also, the acoustic tube 93 may act as a retrieval member for removal of the module 30 from the ear canal. A communication link 50 parallel to the acoustic tube 93 is coupled to an electrical terminal 88 formed on the rear portion of the transducer 30. Alternatively, the acoustic tube 93 and the communication link 50 may be integrated as a single unit. As shown in FIGS. 14-15, the first module 30 may be an RIE, CIC, or ITC component and the second module may be a BTE, ITE, or a similar device. Other types of devices are possible.

Figure 16:
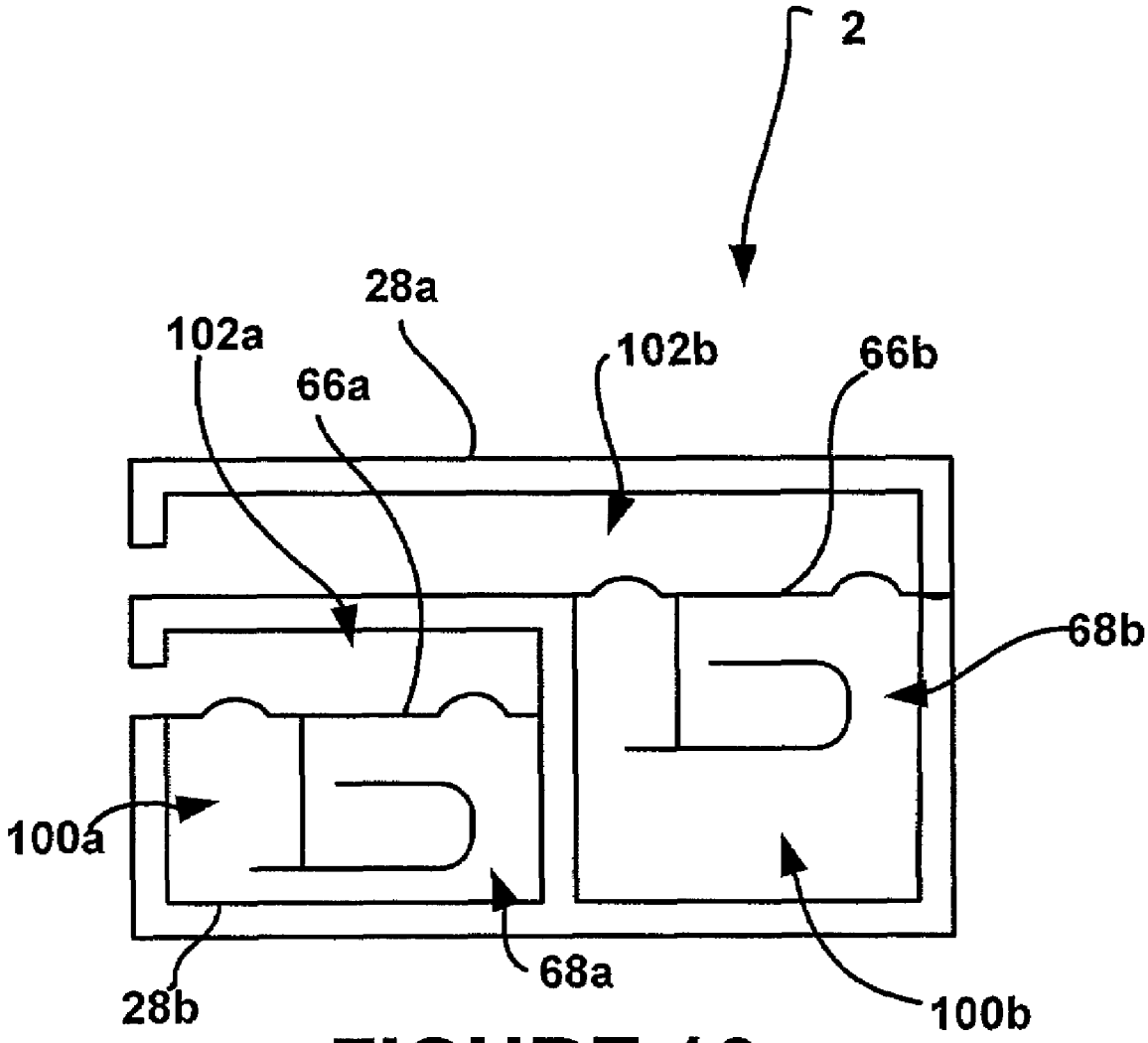
FIG. 16 is a cross-sectional view of another exemplary personal listening device in accordance with various embodiments of the present invention.

FIG. 16 illustrates another example of a module 30. The module 30 includes dual transducers 32, 34. Electrical terminals 88*a*, 88*b* are formed at the rear portion of the transducers 32, 34. Optional wires (not shown) that extend from the terminals 88*a*, 88*b* are coupled to a driving circuit (not shown). As shown, the transducers 32, 34 are mounted either side-by side or end-to-end in order to fit into the ear canal. Each transducer 32, 34 comprise an acoustic assembly and a motor assembly mounted in a housing 28. The housing 28 may be manufactured from any type of moldable or formable material that is corrosion resistant and is bio-compatible for skin contact, including plastic, polycarbonate nylon, liquid crystal polymer (LCP), PEEK, or any other similar materials. Alternatively, part of the housing 28 may be made of magnetically soft metal injection molded material that is capable to function as part of the magnetic return path or electromagnetic shielding for the motor assembly. Such material may be provided to the inner wall of the housing 28, between layers of the bio-compatible, corrosion resistant material, or outer wall of the housing 28. Yet in another example, the housing 28 may be made of any material, including but is not limited to Acetal Copolymer or Homopolymer (POM) (Delrin), Acrylic (PMMA), Acrylonitrile Butadiene Styrene (ABS), Cellulose Acetate (CA, CB, CP), Polyamide (Nylons), Polyimide (Kapton), Polycarbonate (PC) (lexan), Polyethylene Terephthalate (PET), Polyetherimide (PEI) (Ultem), Polyetheretherketone (PEEK), Polyethylene, Polyphenylene Oxide (PPO) (Noryl), Polyphenylene Sulphide (PPS), Polypropylene (PP), Polystyrene, Polyvinyl Chloride (PVC), Styrene Acrylonitrile (SAN/ASA), Polyphtalamide (PPA), Polysulphone, polyphenylsulfone (Radel), polybutylene terephthalate (PBT) (Pocan), Polyphthalamide (PPA), Fluoropolymers, Polyarylate, Silicone, or of any similar like. Material may be a blend of these materials or an alloy of these materials. The material may or may not include additives for providing strength and expansion control such as glass content, carbon fiber, or the like. Other materials for providing one or more features, including electrical conductivity, magnetic conductivity, UV stabilization, moisture absorption, moldability, chemical resistance, temperature resistance, flexibility, durability, or hardness, may or may not added to the base material as disclosed above. Other types of materials are possible. An optional non-biocompatible thin film or layer (not shown) may be provided to the housing 28 such that at least a surface of the housing is covered by the film or layer. Alternatively, the housing 28 comprises layers of material, at least one layer of biocompatible material and at least one layer of non-biocompatible material. In another example, the housing 28 comprises an innermost layer that is made of biocompatible material and at least a portion of the layer is provided with a non-biocompatible thin film or layer. The thin film may be made of any material that enhances electromagnetic performance, adhesive, or corrosion characteristics and environmental protection, such as copper, gold, epoxy, primers, or sealant. Alternatively, other types of thin film for surface treatments to enhance adhesion of parts, sealants to encapsulated and protect parts, paints, treatments, thin films for decorative or other reasons may be used. A second sound outlet port 84*b* of the transducer 34 is provided to direct the acoustic energy to the ear canal through a separate tube 62*b* apart from a first sound outlet port 84*a* formed at the transducer 32. The second tube assembly 62*b* couples to the outlet 84*b* of the transducer 34. It is mounted in an internal cavity 64 of the housing 28 and then extended through a first end 82 of the housing 28. An optional electrical filter such as a crossover network may be provided to one or more of the transducers 32, 34. An optional acoustic modification may be provided to the receiver for alternating the frequency response.

It will be appreciated that numerous variations to the above mentioned approaches are possible. Variations to the above approaches may, for example, include performing the above steps in a different order. Further, one or more structures may be coupled to the system or module. For example, an electrical cross-over network may be coupled to the connector assembly and adapted for modifying the electrical signal to drive the system or module. In another example, the communication link, the connector assembly, or combination thereof containing acoustical pathways such as tubes, channels, horns, cavities, screens, grids, diaphragms, or the like may be provided and attached to the outlet of the system or module adapted for modification the acoustic response. In yet another example, the top housing of the module may be constructed to be readily removed for cleaning or removing the ear wax. Alternatively, an optional door attached to the top housing in connection with the front volume may be opened for cleaning or removing the ear wax. In another example, the outer surface of the housing may have features for snapping an ear tip, or ear dome, an ear retention clip, or other external accessories. In yet another example, the communication link is reversible wherein the personal listening device and the signal source may connect to any two common ends.

All references, including publications, patent applications, and patents, cited herein are hereby incorporated by reference to the same extend as if each reference were individually and specifically indicated to be incorporated by reference and were set forth in its entirety herein.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A receiver module for a personal listening device to be removably fitted in the ear canal, the receiver module having a movable armature, the receiver module comprising:

a motor assembly; a housing defining a chamber, the housing being at least partially constructed of a biocompatible material, wherein the motor assembly is directly disposed and exposed to the chamber without the obstruction of any intervening structure and at least a portion of the housing of the receiver module is allowed to be in direct contact with the skin of the ear canal;

an acoustic assembly communicating with the ear canal through an outlet in the chamber;

wherein the chamber is divided into a front volume and a back volume.

2. The receiver module of claim 1, wherein the housing is entirely constructed of biocompatible material.

3. The receiver module of claim 1, wherein the housing has an inner surface, at least a portion of the inner surface being provided with a non-biocompatible thin film.

4. The receiver module of claim 1, wherein the housing comprises a plurality of layers, at least one layer comprising a non-biocompatible material and wherein an inner layer of the housing in proximity to the motor assembly is a biocompatible material.

5. The receiver module of claim 3 or 4, wherein the thin film for enhancing electromagnetic, adhesive characteristics, corrosion characteristics, and environmental protection is selected from a group consisting of copper, gold, epoxy, primers, or sealant.

6. The receiver module of claim 1, wherein the biocompatible material is selected from the group consisting of plastic, liquid crystal polymer, Acetal Copolymer, Homopolymer, Acrylic, Acrylonitrile Butadiene Styrene, Cellulose Acetate, Polyamide, Polyimide, Polycarbonate, Polyethylene Terephthalate, Polyetherimide, Polyetheretherketone, Polyethylene, Polyphenylene Oxide, Polyphenylene Sulphide, Polypropylene, Polystyrene, Polyvinyl Chloride, Styrene Acrylonitrile, Polyphtalamide, Polysulphone, Polyphenylsulfone, Polybutylene Terephthalate, Polyphthalamide, Fluoropolymers, Polyarylate, or Silicone.

7. The receiver module of claim 1, 2, 3, or 4, further comprising one or more motor assemblies being disposed in the housing.

8. The receiver module of claim 7, further comprising one or more structures selected from a group comprising an acoustic structure and an electrical structure for providing one or more of an acoustic compliance, an acoustic resistance, an acoustic inertance, a damping, an acoustical filter, a tube, a port, a vent, and an electrical filter being disposed in the housing.

9. The receiver module of claim 8, further comprising one or more diaphragms coupled to one or more of the motor assembly, the acoustic structure, and the electrical structure enclosed in the housing.

10. The receiver module of claim 1, 2, 3, or 4, wherein one or more module is being provided, capable of transducing signals is selected from the group consisting of a microelectromechanical machined system (MEMS) silicon-based receiver, a balanced armature receiver, a moving coil receiver, a bone-conduction receiver, a MEMS silicon-based condenser microphone, an electret microphone, an omni-directional microphone, a directional microphone, a dynamic microphone, a monitor microphone, or combination thereof.

11. The receiver module of claim 1, 2, 3, or 4, further comprising a connector assembly that is adapted to couple and decouple to a signal source.

12. The receiver module of claim 11, wherein the signal source is one of a hearing aid, a communication device, a gaming device, an audio device, an electronic device, or combination thereof.

13. The receiver module of claim 1, 2, 3, or 4, wherein a communication link is coupled between a signal source and the receiver module, wherein the communication link is one of a wireless connection or a wired connection.

14. The receiver module of claim 1, 2, 3, or 4, wherein at least a portion of the module is coupled to one of an ear tip, an ear dome, an ear tube, an ear mold, an ear bud, an ear cone, an ear plug, or an open canal support of varying sizes and shapes.

15. The receiver module of claim 14, wherein one of the ear tip, the ear dome, the ear tube, the ear mold, the ear bud, the ear cone, or the ear plug is being detachably coupled from the module.

16. The receiver module of claim 1, 2, 3, or 4, wherein the motor assembly comprising a coil, a magnetic yoke, and a magnet.

17. A receiver module for a personal listening device comprising at least one motor assembly;

a housing defining a chamber, the housing comprising an inner surface, wherein the inner surface in proximity to the motor assembly is constructed from a biocompatible material wherein the motor assembly is exposed to the inner surface of the chamber without the obstruction of any intervening structure and at least a portion of the housing of the receiver module is allowed to be in direct contact with the skin of the ear canal;

an acoustic assembly communicating with the ear canal through an outlet in the chamber;

wherein the chamber is divided into a front volume and a back volume.

18. The receiver module of claim 17, wherein a connector assembly is adapted to couple and decouple the device from a signal source.

19. The receiver module of claim 17, wherein a communication link is coupled between a signal source and the receiver module, wherein the communication link is one of a wireless connection or a wired connection.

20. The receiver module of claim 17, wherein at least a portion of the module is coupled to one of an ear tip, an ear dome, an ear tube, an ear mold, an ear bud, an ear cone, an ear plug, or an open canal support of varying sizes and shapes.

21. A receiver module for a personal listening device to be fitted on or near the ear with provision to attach an acoustic tube to conduct the sound to the ear, the device comprising:

at least one motor assembly comprising an armature, a coil a magnetic yoke, and a magnet;

a housing defining a chamber, the housing being entirely constructed of a biocompatible material and the motor assembly being disposed in the chamber and being exposed to the chamber without the obstruction of any intervening structure and at least a portion of the housing of the receiver module is allowed to be in direct contact with the skin of the ear canal;

an acoustic assembly communicating with the ear canal through an outlet in the chamber;

wherein the chamber is divided into a front volume and a back volume.

22. A receiver module for a personal listening device to be fitted removably in the ear canal comprising:

a motor assembly;

a housing defining a chamber, the housing being constructed of biocompatible material at least partially coated with a non-biocompatible thin coating, wherein the motor assembly is disposed in the chamber and is exposed to the chamber without the obstruction of any intervening structure and at least a portion of the housing of the receiver module is allowed to be in direct contact with the skin of the ear canal;

an acoustic assembly communicating with the ear canal through an outlet in the chamber;

wherein the chamber is divided into a front volume and a back volume.

23. A receiver module for a personal listening device to be fitted removably in the ear canal comprising:

a motor assembly;

a housing having a chamber, the housing being constructed of layers of material, an innermost layer is made of biocompatible material, wherein the motor assembly is disposed in the chamber and is exposed to the chamber without the obstruction of any intervening structure and at least a portion of the housing of the receiver module is allowed to be in direct contact with the skin of the ear canal;

an acoustic assembly communicating with the ear canal through an outlet in the chamber;

wherein the chamber is divided into a front volume and a back volume.

24. A receiver module for a personal listening device to be fitted removably in the ear canal comprising:

a motor assembly;

a housing having a chamber, the housing being constructed of layers of material, an innermost layer being made of biocompatible material at least partially coated with a non-biocompatible thin coating, wherein the motor assembly is disposed in the chamber and is exposed to the chamber without the obstruction of any intervening structure and at least a portion of the housing of the receiver module is allowed to be in direct contact with the skin of the ear canal;

an acoustic assembly communicating with the ear canal through an outlet in the chamber;

wherein the chamber is divided into a front volume and a back volume.

* * * * *

UNITED STATES PATENT AND TRADEMARK OFFICE

CERTIFICATE OF CORRECTION

PATENT NO. : 7,680,292 B2
APPLICATION NO. : 11/755408
DATED : March 16, 2010
INVENTOR(S) : Daniel Max Warren et al.

It is certified that error appears in the above-identified patent and that said Letters Patent is hereby corrected as shown below:

Claim 6, Column 13, Line 31, delete "Polyphtalamide," and insert --Polyphthalamide,--, therefor.

Claim 6, Column 13, Line 31, delete "Polysulphone," and insert --Polysulfone,--, therefor.

Claim 21, Column 14, Line 40, delete "coil" and insert --coil,--, therefor.

Signed and Sealed this
Fifteenth Day of November, 2011

David J. Kappos

David J. Kappos
*Director of the United States Patent and Trademark Office*